United States Patent [19]

Pollock

[11] Patent Number: 4,629,274

[45] Date of Patent: Dec. 16, 1986

[54] ELECTRICAL CONNECTOR

[76] Inventor: Henry J. Pollock, 1726 6th St., Long Beach, Calif. 90802

[21] Appl. No.: 782,890

[22] Filed: Oct. 1, 1985

[51] Int. Cl.[4] ..... H01R 4/24

[52] U.S. Cl. ..... 339/95 R; 339/268 R

[58] Field of Search ..... 339/95 R, 97–99, 339/268

[56] References Cited

U.S. PATENT DOCUMENTS

| | | | |
|---|---|---|---|
| 2,340,011 | 1/1944 | Moore et al. | 339/268 S |
| 2,470,423 | 5/1949 | Alford | 339/97 R |
| 4,268,104 | 5/1981 | Kidder | 339/98 |

*Primary Examiner*—Joseph H. McGlynn

*Attorney, Agent, or Firm*—Charles H. Thomas

[57] ABSTRACT

An electrical connector is provided for joining the ends of two wires together or for joining an end of an electrical wire to a terminal lug. The connector employs a pair of electrically insulating jaws which diverge from an electrically insulating body. The jaws are resiliently biased apart and have mutually facing surfaces and opposite back surfaces. The back surfaces are configured with transverse serrations forming sawteeth that slope outwardly away from the body. Electrically conductive layers on the facing surfaces of the jaws define transverse clamping serrations. An annular clamping ring encircles the jaws and is longitudinally moveable therealong away from the body to force the jaws toward each other. The clamping ring thereby closes the jaws on the end of an electrical lead inserted between the jaws. The distance between the outwardly sloping serrations remote from the body is progressively greater than the distance between the sawteeth serrations proximate to the body, so that movement of the clamping ring toward the divergent ends of the jaws is limited. The slope of the transverse sawteeth prevents the clamping ring from moving back toward the body. Connectors may be configured with jaws at both ends to connect electrical leads together, or with an electrical termination lug at one end.

15 Claims, 5 Drawing Figures

ELECTRICAL CONNECTOR

BACKGROUND OF THE INVENTION

1. Field of the Invention

The present invention relates to electrical connectors for connecting electrical leads together and to electrical termination lugs.

2. Description of the Prior Art

In innumerable electrical devices and electrical circuitry there is a necessity for making a mechanical connection of an electrical lead or wire to a connecting terminal or post, or to another wire or group of wires. Where such mechanical connections of electrical conductors are necessary, any number of varieties of terminal lugs may be utilized. Conventional electrical termination lugs are manufactured of electrically conductive metals in a variety of configurations. One configuration is in the form of an annular eyelet, the central aperture of which fits over a terminal post. In an alternative configuration a U-shaped lug is employed which includes a pair of parallel fingers, spaced apart, to fit on either side of a termination post. The eyelet design is employed in applications where the terminal lug is to be immoveably captured, while the U-shaped terminal lug is employed to facilitate connection and disconnection of the lug. Other types of terminal lugs are also employed in a wide variety of configurations and sizes.

In conventional practice, wires are fastened to electrical teminal lugs in several ways. According to one conventional technique, a sleeve on the terminal lug is crimped onto the end of a wire so that the sleeve frictionally engages the wire. To effectuate a reliable connection, crimping must be performed with pliers especially designed for this purpose. Another alternative method of attaching the end of a wire to a terminal lug is to solder the wire to the lug. A fusible solder and a soldering iron are required to effectute such a connection.

In still another conventional method of attachment the lug is provided with a screw terminal. The end of the wire is wrapped around the shank of the screw, and the screw is tightened to clamp the wire against a backing. A closely related technique utilizes a clamping nut threadably engaged on the shank of a screw terminal post. While such connections require only a screwdriver or general purpose pliers, the connection effectuated is frequently defective. That is, as the screw or nut is turned to clamp against the wire, the wire often will slip or the head of the clamping screw or the nut will frequently laterally displace the wire, so that the connection effectuated is not secure.

All of the conventional means for connecting wires to terminal lugs require special tools or result in unreliable connections, and often suffer from both disadvantages. Soldered connections break when flexed too severely. Screws sometimes become loosened and the frictional engagement afforded by a crimp likewise sometimes is too loose initially or later becomes loose.

Many alternative connectors have been devised to attempt to improve upon the commonly used conventional electrical wire connectors. One such device is the so-called "wire nut". However, this device is applicable only to connecting the ends of two or more wires. Also, it fails to produce a positive mechanical lock if the wrong size is used, or if it is carelessly installed. Other connectors which have been devised are frequently too bulky or complex, and thus have failed to gain commercial acceptance.

SUMMARY OF THE INVENTION

The present invention is an improved electrical connector. One embodiment of the invention may be employed to connect the ends of wires to terminal lugs. Another embodiment is used to connect the ends of wires together. All embodiments of the electrical connector of the invention are comprised of at least one pair of electrically insulating jaws joined at a common end. The jaws are preferably resiliently biased apart, and each jaw has a facing surface and an opposite back surface. The back surfaces on the jaws are serrated to define transverse sawteeth sloping outwardly and away from the common end at which the jaws are joined. Electrically conductive transverse clamping teeth are formed on the mutually facing surfaces of the jaws. An annular clamping ring is disposed about the pair of jaws for movement therealong in a direction away from the common end and toward the divergent ends of the jaws. An electrical contact at the common end is electrically connected to the clamping teeth. The electrical contact may be connected to an electrical termination lug, if a wire is to be attached to an electrical termination post. Alternatively, the electrical contact may be connected to another, similar pair of jaws equipped with a clamping ring if the ends of two wires are to be joined together.

In the operation of the electrical connector of the invention, the end of a wire is stripped and placed between the divergent ends of the jaws. The clamping ring is pulled from a location near the junction of the jaws at the common end, toward the divergent ends of the jaws. As the clamping ring advances it passes over the transverse sawteeth that slope outwardly and away from the common end. The slope of the sawteeth prevents the clamping ring from passing back toward the common end at which the jaws are joined. That is, the sawteeth act as a ratchet and the interior edge of the clamping ring acts as a pawl. Since the ends of the jaws are divergent, even when clamped upon the end of the wire, the clamping ring can only be moved beyond the transverse sawteeth which just span the opening in the clamping ring when the jaws are tightly clamped. When the limit of longitudinal movement is reached, the radially inward force by the clamping ring upon the jaws causes the clamping teeth to tightly grip both the electrically conductive wire, and the end of the insulation on the wire. This establishes an electrical connection through the electrically conductive clamping teeth to the electrical contact within the body of the connector. Since the end of the insulation on the wire is also clamped, there is no exposure of the bare wire which could result in an electical short circuit or present an electrical shock hazard.

In one embodiment of the invention a pair of jaws, each equipped with a clamping ring as aforesaid, are provided. The jaws diverge from opposite ends of a tubular body housing the electrically conductive contact or core. Such an embodiment is used for connecting the ends of two wires together. Alternatively, the body may be provided with but a single pair of jaws and the electrical contact may be connected to a conventional terminal lug. Such an embodiment is employed to connect the end of an electrical wire to an electrical terminal lug adapted to be connected to a contact post.

Preferably, a longitudinal grove is defined in each of the facing surfaces of the jaws. The groove is widest and deepest at the free divergent ends of the jaws, and becomes narrower and shallower toward the common or junction end of the jaws. The clamping teeth extend down into the grooves. When grooves are defined in the jaws in this manner, a stripped end of a wire may be inserted further into the jaws toward the common end thereof than is possible in the absence of such grooves. The grooves thereby allow more clamping teeth to grip the bare, stripped end of the wire, and the end of the insulation. Also, the grooves maintain the end of the wire centered between the jaws.

One unique aspect of the improved electrical connector of the invention is that the clamping teeth not only provide a positive lock upon the electrically conductive wire itself, but also upon the end of the insulation at the bare end of the wire. The insulation therefore cannot slip from the clamping device to expose the bare wire. This eliminates a source of electrical short circuits. Also, by eliminating exposure of the bare wire, a source of electrical shock is thus eliminated, as well.

The electrical connector of the invention eliminates the requirement for any special tools to complete the installation processes. In the preferred embodiment the end of the wire is stripped, so that a wire stripping tool is useful. However, the clamping teeth of the jaws can be formed sharp enough to penetrate through the insulation to make electrical contact with the wire, without the necessity for stripping the wire. By stripping the end of the wire, however, there is greater assurance of good electrical contact between the clamping teeth and the conductive core of the wire.

A clamping ring according to the invention should be constructed of a rigid material, and may resemble an O-ring or washer in configuration. However, the clamping ring may also be a longer, tubular structure, in which case the interior surface of the ring can also be tapered and may be provided with a plurality of ratchet teeth opposing the transverse sawteeth on the outer back surfaces of the jaws. This provides a more positive lock and also provides the connector with a smoother, more finished appearance. However, an annular disc-like ring will suffice for most purposes, and involves the simplest and most economical form of construction.

The electrical connector of the invention may employ an electrically insulating body, from at least one end of which a pair of electrically insulating jaws extend in diverging fashion. The body is preferably formed of a rigid plastic material, such as polyvinylchloride, polycarbonate, ABS, or some equivalent material. The annular clamping ring is likewise preferably formed of rigid plastic. The connector may also be provided in different colors to conform to standard color coding of electrical circuits. That is, for example, green connectors may be employed with ground wires, white connectors in a circuit ground return path, black connectors with "hot" wires, and so forth.

The invention may be described with greater clarity and particularity by reference to the accompanying drawings.

DESCRIPTION OF THE EMBODIMENTS

Figure 1:
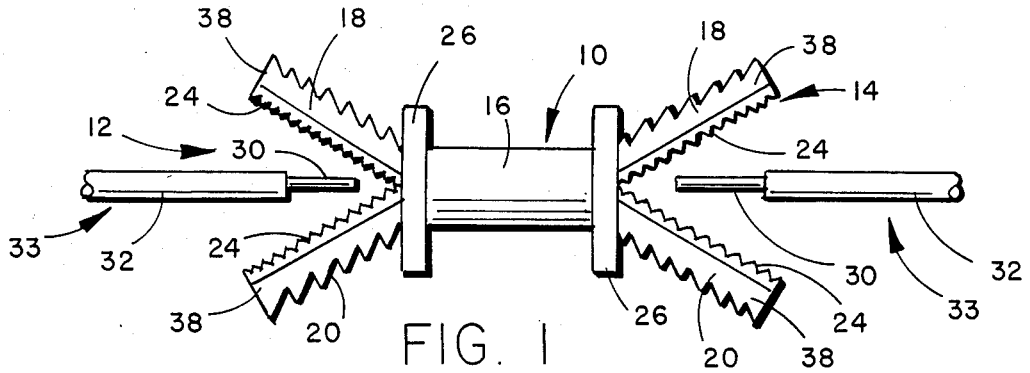
FIG. 1 is a side elevational view of a double ended connector, according to the invention, with jaws open.
Figure 3:
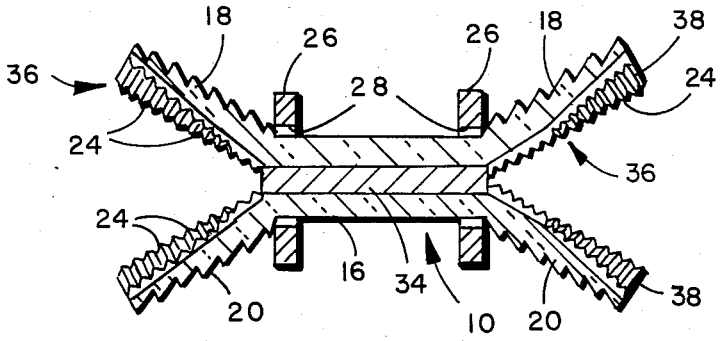
FIG. 3 is a sectional elevational view of the connector of FIG. 1.

FIG. 1 illustrates an electrical connector 10 comprised of two pairs of diverging jaws 12 and 14 connected to opposite ends of a tubular body 16. The jaws 12 and 14 and the body 16 are all constructed of an electrically insulating material, such as polyvinylchloride plastic. Each of the pairs of jaws 12 and 14 includes opposing jaw elements 18 and 20 which are resiliently biased apart by the stiffness of the thermoplastic material from which the jaw pairs 12 and 14 are formed. The jaws 18 and 20 in each pair of jaws are joined at a common end at the body 16 and diverge apart at an acute angle, as illustrated in FIGS. 1 and 3. The jaws 18 and 20 have mutually facing surfaces, and opposite back surfaces. The back surfaces face outwardly and are serrated to define transverse sawteeth 22. As illustrated, the sawteeth 22 slope outwardly and away from the ends of the body 16.

Figure 2:
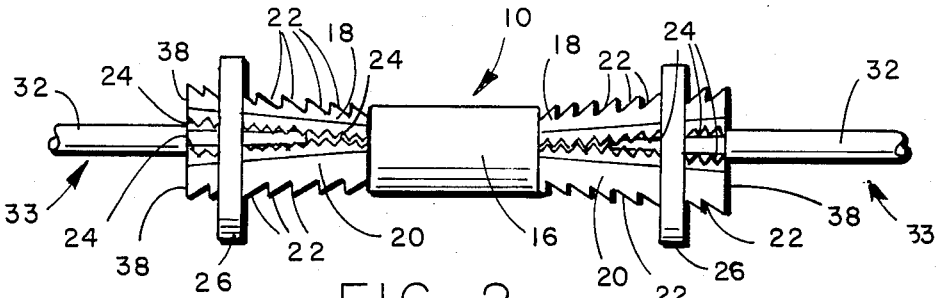
FIG. 2 is a side elevational view of the connector of FIG. 1 showing the jaws closed.

The facing surfaces of the jaws 18 and 20 are covered with a layer of metal, bonded thereto, as by an adhesive. Alternatively, the jaws 18 and 20 may be molded about metallic structures defining the metal layers. The metal layers define electrically conductive, transverse clamping teeth 24 on the facing surfaces of the jaws 18 and 20. A separate annular clamping ring 26, with a central, circular opening 28 therethrough, is positioned about each of the pairs 12 and 14 of jaws 18 and 20. The annular clamping rings 26 are initially positioned about the opposite ends of the body 16, as depicted in FIG. 3. The clamping rings 26 are moveable along the pairs 12 and 14 of jaws 18 and 20 away from the body 16 and toward the divergent ends 38 of the jaws 18 and 20. The clamping rings 26, when moved longitudinally from the position of FIGS. 1 and 3 to the position of FIG. 2, close the jaws 18 and 20 toward each other. When the clamping rings 26 are moved longitudinally in the direction of divergence of the jaws, as illustrated in FIG. 2, they exert radial inwardly directed forces against the opposite, exposed back surfaces of the jaws 18 and 20. These forces cause the clamping teeth 24 to tightly grip the bare ends 30 and surrounding insulation 32 of the ends 33 of electrically conductive wires therebetween. The diverging jaws 18 and 20 limit the longitudinal movement of the clamping rings 26. Electrical continuity between the clamping teeth 24 at the opposite ends of the connector 10 is provided by a central, cylindrical, metal core 34 within the body 16, best illustrated in FIG. 3.

Figure 4:
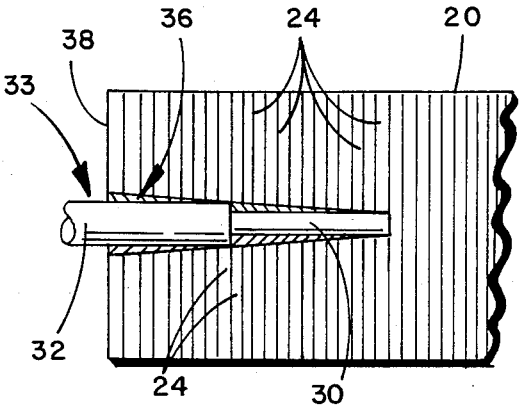
FIG. 4 is a detail plan view of one of the mutually facing surfaces of one of the jaws of the connector of FIG. 1.

As illustrated in FIGS. 3 and 4, a groove 36, of V-shaped cross section, is defined in each of the facing surfaces of the jaws 18 and 20. The grooves 36 are widest and deepest at the divergent ends 38 of the facing surfaces of the jaws 18 and 20, and narrowest and shallowest closest to the common ends of the jaws in each pair where the jaws join the body 16. As best illustrated in FIG. 4, the grooves 36 form generally triangular indentations into the facing surfaces of the jaws 18 and 20. The transverse teeth 24 are formed into the walls of the V-shaped crevices defined by the grooves 36, as well as upon the otherwise flat, surrounding surfaces of the jaws 18 and 20. The layers of metal upon which the clamping teeth 24 are defined extend all the way to the common ends of the jaws 18 and 20, and are electrically connected to the central, electrically conductive cylindrical core 34.

When the ends 33 of two wires are to be joined longitudinally together, their extremities 30 are stripped bare and positioned between the jaws 18 and 20 in each of the jaw pairs 12 and 14, as depicted in FIG. 1. The ends of the wires are positioned in alignment with the grooves 36, as illustrated in FIG. 4. The annular clamping rings 26 are thereupon pushed away from each other and from the body 16 toward the divergent ends 38 of the jaws 18 and 20. This longitudinal movement closes the jaws 18 and 20 together, as illustrated in FIG. 2. The radially inwardly directed forces exerted by the structures of the clamping rings 26 cause the clamping teeth 24 to tightly grip both the bare tips 30 and the adjacent insulation 32 of the ends 33 of wire within the pairs 12 and 14 of jaws 18 and 20, as depicted in FIG. 2.

The span between the transverse sawteeth 22 at the divergent ends 38 of the jaws 18 and 20 is greater than the span between longitudinally aligned sawteeth proximate to the body 16. That is, the span between the crests of the sawteeth 22 increases progressivly from the ends of the body 16 toward the divergent ends 38 of the jaws 18 and 20. The span between the crests of the sawteeth 22 at the ends 38 is greater than the diameter of the apertures 28 through the clamping rings 26. In the embodiment of FIGS. 1-3, this is a result of the wedging effect of the thickness of the bare wire tips 30 and the insulation 32 between the coacting jaws 18 and 20. Alternatively, however, the jaws 18 and 20 may be constructed thicker at the divergent ends 38 than proximate to the body 16. In either event, it is necessary for the diameter of the apertures 28 in the clamping rings 26 to be smaller than the span of the sawteeth at the divergent ends 38 and greater than the span of the sawteeth 22 at the common ends of the jaws 18 and 20 at the ends of the body 16, when the ends 33 of wires are inserted into the jaws.

FIG. 2 illustrates the electrical connector 10 firmly engaged upon the ends 33 of two longitudinally aligned insulated electrical wires. The clamping rings 26 are forced longitudinally apart away from the center of the body 16 as far as they will go toward the divergent ends 38 of the jaws 18 and 20. The slope of the sawteeth 22 outwardly and away from the body 16 allows the clamping rings 26 to readily pass outwardly away from the center of the body 16, but prevents the clamping rings 26 from moving in the opposite direction, back toward the center of the body 16. In this respect the transverse, inner edges of the clamping rings 26 at the apertures 28 act as pawls and the sawteeth 22 act as racks.

As the clamping rings are moved from the position of FIG. 1 to the position of FIG. 2, the increased size of the span between the crests of the teeth 22 presents increased resistance to passage of the clamping rings 26 thereover. As the clamping rings 26 are moved longitudinally outwardly from the body 16, the jaws 18 and 20 are closed toward each other, and the acute angle therebetween becomes progressively smaller. The clamping teeth 24 are pressed toward each other and form a positive mechanical lock on both the bare tips 30 and the insulation 32 of the ends 33 of the wire between the pairs 12 and 14 of jaws 18 and 20. FIG. 2 illustrates the limit to which the clamping rings 26 may be moved longitudinally apart away from each other. That is, the clamping rings 26 cannot be moved over the crests of the next sets of sawteeth 22 located longitudinally outwardly between the clamping rings 26 and the divergent ends 38 of the jaws 18 and 20.

Figure 5:
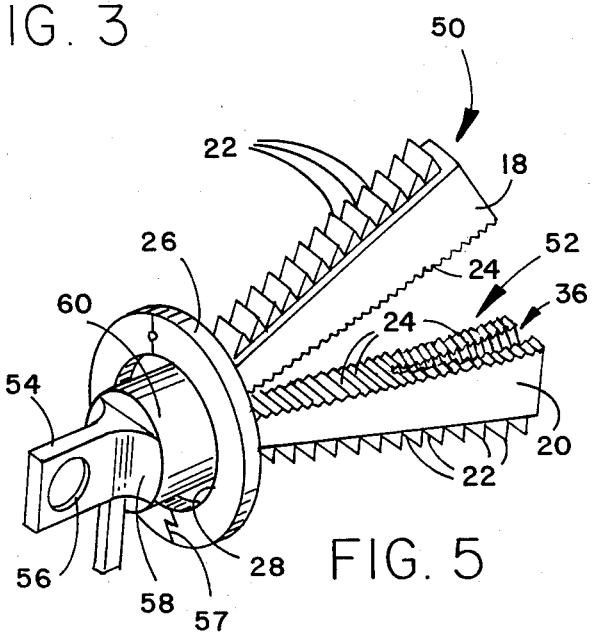
FIG. 5 is a perspective view of an alternative embodiment of the invention.

The embodiment of FIGS. 1-3 illustrates the manner of interconnection of two longitudinally aligned wires. FIG. 5 illustrates an alternative embodiment of the invention. The electrical connector 50 employs but a single pair of jaws 52, which are identical in construction to the pairs 12 and 14 of jaws of the electrical connector 10. The structural elements of the electrical connector 50 which are identical to those of the electrical connector 10 bear the same reference numbers in FIG. 5. The electrical connector 50 differs from the electrical connector 10 in that but a single pair 52 of jaws 18 and 20 is provided. Also, an electrical terminal lug 54 is employed in place of the second set of jaws. The electrical terminal lug 54 includes a transverse central aperture 56 designed to received an electrical terminal post. The terminal lug 54 is electrically connected to the clamping teeth 24 through a generally rectangular electrical core 58 located within an annular, electrically insulating body 60. The operation of the clamping ring 26 upon the jaws 18 and 20 in the jaw pair 52 of the electrical connector 50 is identical with that previously described in connection with the electrical connector 10. The electrical connector 50 thereby provides an improved device for connecting the end of an electically conductive wire to an electrical terminal, such as a terminal post.

If desired, the clamping ring 26 may be split, as indicated at 57 in FIG. 5. This allows the aperture 28 to be enlarged, if desired, so as to allow removal of a wire from the jaw pair 52, without destroying the electrical connector 50. The structure of the clamping ring 26 is sufficiently rigid so that it will not accidentally spread apart at the split 57.

Undoubtedly, numerous variations and modifications of the invention will become readily apparent to those familiar with electrical connectors. Accordingly, the scope of the invention should not be construed as limited to the specific embodiments depicted and described, but rather is defined in the claims appended hereto.

I claim:

1. An electrical connector comprising an electrically insulating body, at least one pair of electrically insulating jaws diverging from said body and resiliently biased apart and having mutually facing surfaces and opposite back surfaces, wherein said back surfaces are configured with transverse sawteeth serrations sloping outwardly and away from said body, electrically conductive layers on said facing surfaces of said jaws defining transverse clamping serrations thereon, an annular clamping ring encircling said jaws and longitudinally moveable therealong in a direction away from said body to force said jaws toward each other, and an electrically conductive core within said body in electrical contact with said electrically conductive layers.

2. An electrical connector according to claim 1 further comprising two pairs of jaws as aforesaid and two clamping rings as aforesaid at opposite ends of said body, and said electrically conductive layers are all in electrical contact with each other.

3. An electrical connector according to claim 1 further comprising an electrical terminal lug connected to said core.

4. An electrical connector according to claim 1 further characterized in that a longitudinal groove is defined in each of said facing surfaces.

5. An electrical connector according to claim 4 wherein said grooves are widest at the diverging ends of said jaws.

6. An electrical connector comprising at least one pair of diverging jaws constructed of an electrically insulating material and formed with facing surfaces and back surfaces opposite thereto, and said back surfaces are formed with transverse sawteeth sloping outwardly and in the direction of divergence of said jaws, and said facing surfaces include electrically conductive transverse clamping teeth thereon for attachment to an electrical lead, and an annular clamping ring is disposed about said jaws and is longitudinally moveable in the direction of divergence of said jaws to force said jaws toward each other.

7. An electrical connector according to claim 6 further comprising two pairs of jaws as aforesaid and a ring, disposed about each of said pairs of jaws, as aforesaid wherein said clamping teeth are all in electrical contact with each other.

8. An electrical connector according to claim 6 further comprising an electrical terminal lug in electrical contact with said clamping teeth.

9. An electrical connector according to claim 6 further comprising longitudinal grooves in each of said facing surfaces.

10. An electrical connector comprising at least one pair of electrically insulating jaws joined at a common end and resiliently biased apart, said jaws each having a facing surface and an opposite back surface, wherein said back surfaces are serrated to define transverse sawteeth sloping outwardly and away from said common end, electrically conductive transverse clamping teeth on said facing surfaces, an annular clamping ring disposed about said pair of jaws for movement therealong away from said common end to close said jaws, and an electrical contact at said common end connected to said clamping teeth.

11. An electrical connector according to claim 10 further comprisng two pairs of said jaws with a clamping ring as aforesaid disposed about each of said pairs of jaws and wherein all of said clamping teeth are electrically connected to said electrical contact.

12. An electrical connector according to claim 10 further comprising an electrical terminal lug joined to said electrical contact.

13. An electrical connector according to claim 10 wherein a groove is defined in each of said facing surfaces.

14. An electrical connector according to claim 13 wherein said grooves are widest remote from said common end and narrowest closest to said common end.

15. An electrical connector according to claim 13 wherein said grooves are deepest remote from said common end and shallowest closest to said common end.

* * * * *